US005740628A

United States Patent [19]

Almond

[11] Patent Number: 5,740,628

[45] Date of Patent: Apr. 21, 1998

[54] REMOVABLE SECURITY APPARATUS FOR BUILDING OPENINGS

[76] Inventor: Gary L. Almond, 3404 Osborne Blvd., Racine, Wis. 53405

[21] Appl. No.: 611,598

[22] Filed: Mar. 8, 1996

[51] Int. Cl.[6] ..... E05B 65/10

[52] U.S. Cl. ..... 49/141; 49/57; 49/506

[58] Field of Search ..... 49/50, 57, 463, 49/141, 506

[56] References Cited

U.S. PATENT DOCUMENTS

| | | | |
|---|---|---|---|
| 999,682 | 8/1911 | Suits . | |
| 1,105,791 | 8/1914 | Irving . | |
| 1,507,478 | 9/1924 | Gray . | |
| 1,657,908 | 1/1928 | Wulftange . | |
| 1,730,151 | 10/1929 | Kemp . | |
| 2,722,722 | 11/1955 | Mussman . | |
| 3,763,615 | 10/1973 | Yamazaki . | |
| 3,871,151 | 3/1975 | Der Estephanian . | |
| 4,038,800 | 8/1977 | Daley, Jr. . | |
| 4,162,590 | 7/1979 | Earley . | |
| 4,416,084 | 11/1983 | Zen . | |
| 4,445,589 | 5/1984 | Longenecker | 49/141 X |
| 4,495,728 | 1/1985 | Lynn | 49/141 |
| 4,593,492 | 6/1986 | Lumenello . | |
| 4,653,226 | 3/1987 | Woodrow . | |
| 4,881,354 | 11/1989 | Pitt . | |
| 4,897,961 | 2/1990 | Shine | 49/141 |
| 5,269,096 | 12/1993 | Hade . | |
| 5,339,567 | 8/1994 | Pierpont et al. . | |
| 5,392,570 | 2/1995 | Cowan . | |

*Primary Examiner*—Jerry Redman

*Attorney, Agent, or Firm*—Jansson, Shupe, Bridge & Munger, Ltd.

[57] ABSTRACT

A removable security bar apparatus for preventing ingress to a building opening such as a window or door. The apparatus includes a grille and moveable latch remote from the opening. The apparatus may be quickly removed from the opening and used as a ladder to exit the building through the opening in the event of an emergency.

17 Claims, 4 Drawing Sheets

REMOVABLE SECURITY APPARATUS FOR BUILDING OPENINGS

FIELD OF THE INVENTION

This invention is related generally to moveable and removable closures and, more particularly, to protective grilles for securing building openings.

BACKGROUND OF THE INVENTION

Crime is fast becoming a major concern to families, businesses and organizations. Hardly a day passes without some news story relating to a burglary or forced entry into a home or business. Almost everyone knows someone who has had their home, business or organization burglarized resulting in theft, property damage, personal injury, or more serious harm.

Security doors and windows are a well known means of preventing criminals from entering a building through a building opening. Security doors and windows typically consist of heavy metal bars or grates that are placed over a window or door opening to prevent criminals from entering the building. These security systems are typically secured to the building opening in a permanent manner (i.e., they are not removable). U.S. Pat. Nos. 4,162,590 (Earley), 3,871,151 (Der Estephanian) and 1,657,908 (Wulftange) are examples of permanently-mounted security bars or grates.

While permanently-mounted security bars may prevent criminals from breaking into a building they also present serious safety concerns for people in the building. For example, security bars may prevent egress in the event of an emergency such as a fire. A person inside the structure who would normally escape the fire by exiting through a basement or ground floor window could find his or her means of egress blocked.

In response to this serious safety problem, others have sought to develop security bars which can be removed in the event of an emergency. U.S. Pat. Nos. 5,339,567 (Pierpont), 5,269,096 (Hade), 4,653,226 (Woodrow), 1,507,478 (Gray) and 999,682 (Suits) are all examples of removable security devices.

However, these removable security bar devices all have certain disadvantages. For example, Pierpont, Hade, Gray and Suits each secure their bars with a key-actuated lock located near the window opening. Operation of a lock would be impossible if the key were lost or misplaced. In addition, operation of a lock may be beyond the ability of a person who is panicking in an emergency situation such as a fire or criminal home invasion. Minimally, a person in a state of panic would require excessive time to actuate the lock; such time may not be available in an emergency. The close proximity of these locks to the window openings may also make these inventions vulnerable to a burglar skilled in dismantling locks.

Even if the security bar of these devices were removable, the location of the window could cause serious problems for a person seeking to exit the building in an emergency. For example, basement and ground floor windows (such as casement windows) are often secured by window bars because they are located near ground level and are potential entry points for burglars. However, these types of windows may be located five or six feet off the floor making it impossible for a person inside the building to climb up to the window in order to exit the building. A ladder would be required to gain access to such a window and a ladder is not typically available—particularly in an emergency situation.

The location of the window may also provide problems in reaching the ground once a person has opened the window. For example, first floor units of many Victorian-style buildings are located six to eight feet above ground level. It would be difficult for some people to jump such a distance in the event of an emergency. A ladder would be required to exit the building under such circumstances and, again, it is unlikely that a ladder would be available in an emergency.

A security system which would prevent ingress through a building window or other opening yet also serve as a ladder-like support to facilitate immediate exit from the building opening by a person inside the building would represent an important advance in the art.

OBJECTS OF THE INVENTION

It is an object of this invention to provide an improved security apparatus overcoming some of the problems and shortcomings of devices of the prior art.

Another object of this invention is to provide an improved security apparatus which securely covers a window or other building opening thereby preventing ingress to the building.

Yet another object of this invention is to provide an improved security apparatus which remains securely in place without the need for a key-actuated lock.

A further object of this invention is to provide an improved security bar apparatus which may be rapidly and easily removed from a window or other building opening facilitating egress from the building.

It is also an object of this invention to provide an improved security bar apparatus which can serve as a support to gain access to a building opening located above the floor of a room thereby facilitating egress from the building.

An additional object of this invention is to provide an improved security bar apparatus which can serve as a support outside the building thereby facilitating egress from the building.

These and other important objects will be apparent from the following descriptions and from the drawings.

SUMMARY OF THE INVENTION

Briefly described, the invention is an apparatus for preventing ingress through a building opening and for facilitating egress through such opening in an event such as a fire or other emergency. The apparatus includes a grille structure removably secured with respect to the opening. The grille structure has an upper horizontal bar member, at least one lower horizontal bar member and a pair of laterally-disposed vertical members coupled to the horizontal members.

The invention further includes a latch mechanism remote from the opening for limiting movement of the grille structure. The inventive combination permits the latch mechanism to be manipulated only from inside the building. It is preferred that the latch mechanism be pivotally mounted to an interior wall surface region remote from the opening and that the latch may be quickly moved to a position which does not interfere with removal of the grille. It is highly preferred that the latch mechanism include an arm having an opening for attaching the latch to the remote surface and a latch stop member attached to the arm for engaging one of the horizontal bar members.

The grille is preferably removably secured with respect to the opening by a pair of upper grille supports positionable inside the building for receiving one horizontal bar member and a pair of lower grille supports positionable inside the building for receiving another horizontal bar member of the grille. It is most preferred that the supports are formed of the upwardly-opening hooks.

It is highly preferred that the grille supports be positionable adjacent to the vertical members to interfere with lateral movement of the grille structure. Preferably, the top elongate horizontal member has first and second ends which project beyond the vertical members and each end terminates in a bar stop member. Preferably each upper grill support is positionable between its respective vertical member and stop member to interfere with lateral movement of the grille.

As described and shown herein, the grille structure also acts as a ladder-like support for exiting the building through the opening. In this support configuration, it is preferred that the lower grille supports are configured and arranged to receive the upper horizontal bar member and that the upper horizontal bar member be positionable in such lower grille supports. It is also preferred that the grille structure have a bearing end opposed from the upper horizontal member for supporting the grille on a bearing surface.

The invention may also be placed outside the building on exterior supports to act as a ladder-like support for exiting the building to a ground surface. This novel embodiment preferably includes a pair of exterior grille supports positionable on the building exterior surface configured and arranged to receive the upper horizontal bar member. The upper horizontal bar member is positionable in the lower grille supports.

It is preferred that the apparatus further include a pair of grille extenders each pivotally mounted to a vertical member and extensible toward the building exterior and stop members on the grille to position the extenders for supporting the grille against the building. The device may then be used much like a fire escape to exit the building.

The invention also includes a method of preventing ingress through a building opening comprising the steps of: (a) providing a grille structure having upper and lower horizontal bar members and a pair of lateral members (also referred to herein as vertical members) coupled to the horizontal members, (b) securing a latching mechanism remote from the window opening, (c) removably securing the grille structure with respect to the opening, and (d) engaging the latching mechanism to the grille structure to prevent removal thereof.

The inventive method may further includes the steps of: (a) disengaging the latching mechanism, (b) removing the grille structure from the opening, (c) securing the grille structure inside the building and with respect to the opening such that the grille structure acts as a support for gaining access to the opening for egress through the opening, and (d) climbing the grille structure to exit the building through the opening.

The method of the invention also includes steps for exiting the opening to the ground outside the building including the steps of: (a) disengaging the latching mechanism, (b) removing the grille structure from the opening, (c) securing the grille structure outside the building and with respect to the opening such that the grille structure acts as a support for egress through the opening, and (d) exiting the building through the opening.

DETAILED DESCRIPTIONS OF THE PREFERRED EMBODIMENTS

Figure 2:
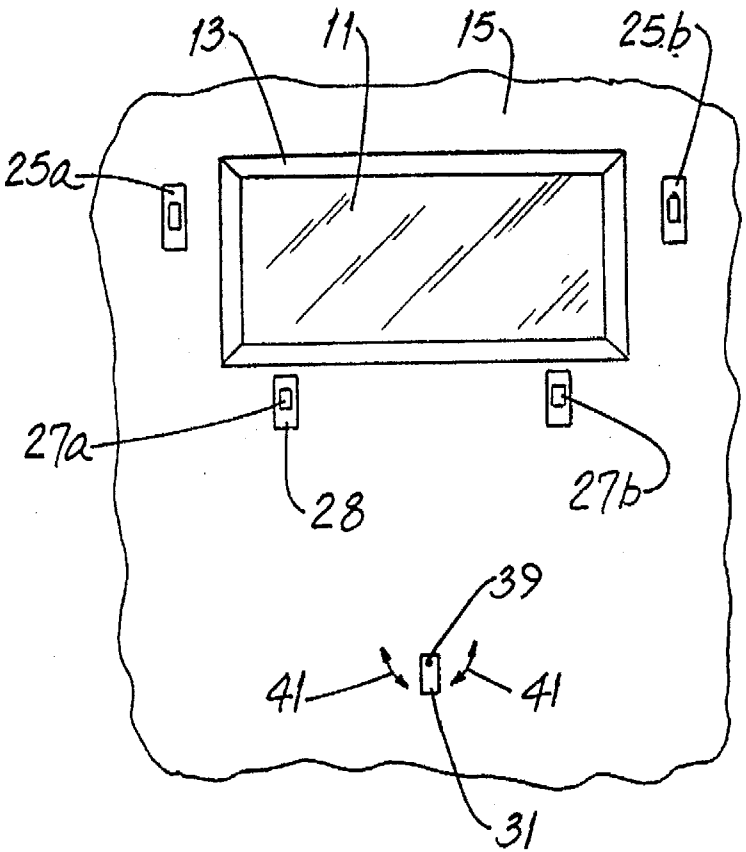
FIG. 2 is a front elevation of the invention with the grille removed.
Figure 1:
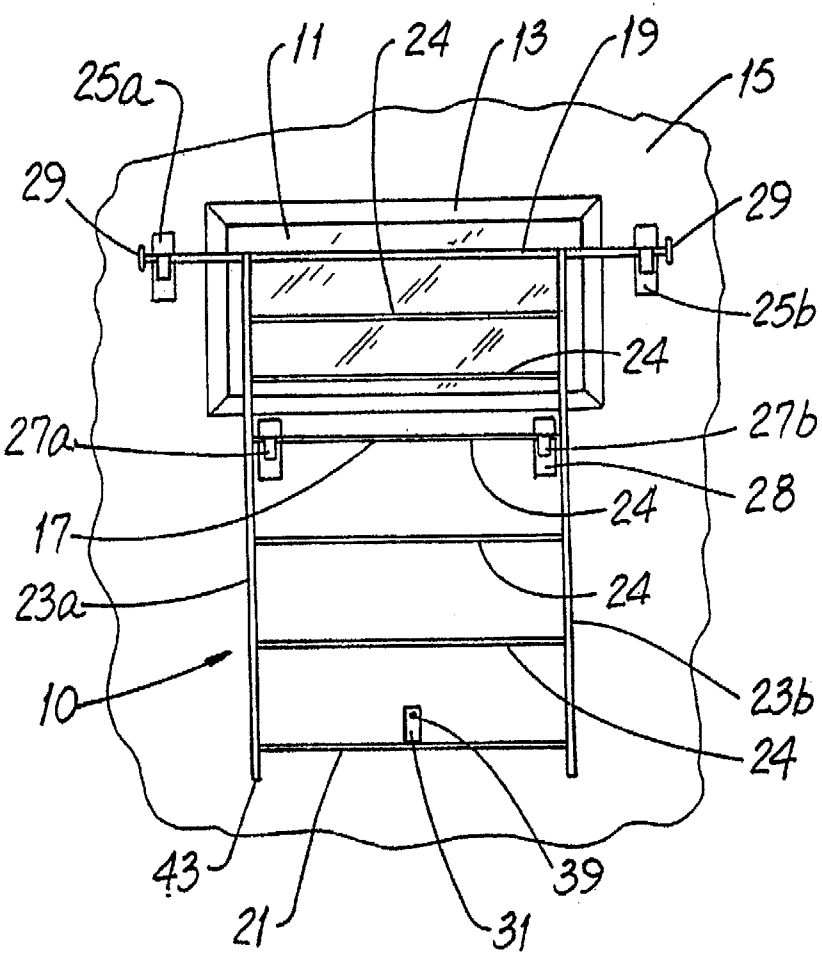
FIG. 1 is a front elevation of the invention showing a grille mounted over a window opening.
Figure 8:
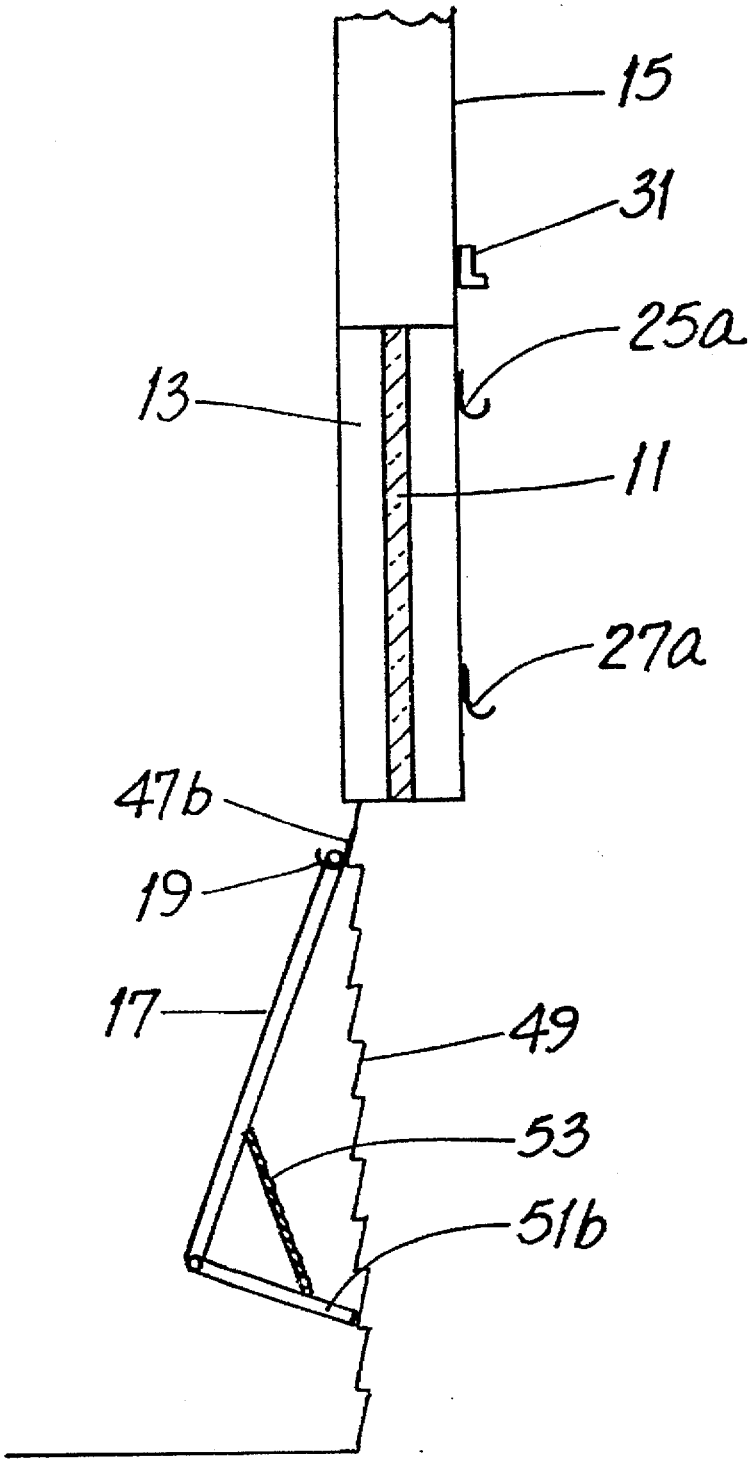
FIG. 8 is a side elevation of the invention with the grille positioned outside a building in a further "support position" to facilitate egress through the building opening.

FIGS. 1 and 2 show one embodiment of Applicant's inventive security apparatus 10 positioned inside a building such as a home or business. Apparatus 10 is intended to prevent burglars and the like from gaining unauthorized entry to a building through window 11 secured in window opening 13. In the example shown, opening 13 is positioned in wall surface 15 and above a floor surface (not shown). Such an exemplary opening 13 is typically found in a garden level apartment or in a below-grade basement. However, such an opening 13 could also be commonly found at an above-ground-level location such as shown in FIG. 8.

The invention includes a grille structure 17 removably secured with respect to opening 13. Grille 17 is positioned inside the building. Grille 17 has an upper horizontal bar member 19 at least one lower horizontal bar member 21 and a pair of lateral members **23*a* and 23*b* (also referred to as vertical members 23*a* and 23*b*) coupled to the horizontal members 19 and 21. Preferably, a plurality of horizontal members 24 are provided on grille 17. Grille 17** may be made of any suitable material although wrought iron is preferred because of its strength and ease of manufacture.

In preferred embodiments, grille 17 is removably supported with respect to opening 13 by a pair of upper grille supports **25*a* and 25*b* and a pair of lower grille supports 27*a* and 27*b* positioned inside the building on wall surface 15. FIG. 1 shows grille 17 positioned on supports 25*a*, 25*b* and 27*a*, 27*b*. FIG. 2 shows supports 25*a*, 27*b* and 27*a*, 27*b* with grille 17 removed. Upper grille supports 25*a*, 25*b* receive one horizontal bar member 19 and lower grille supports 27*a*, 27*b* receive another horizontal bar member such as bar member 24. Preferably, the supports are upwardly-opening hooks each mounted to a plate 28 although any comparable support will suffice. Again, wrought iron is a preferred material for the supports 25*a*, 25*b* and 27*a*, 27*b***.

Upper grille supports **25*a*, 25*b* and lower grille supports 27*a*, 27*b* are attached to wall surface 15 by means of any suitable fastener (not shown). Upper 25*a*, 25*b* and lower 27*a*, 27*b* grille supports are positioned on wall surface 15 adjacent to lateral members 23*a*, 23*b* so as to interfere with lateral movement of the grille 17. In the preferred embodiment shown, each upper grille support 25*a*, 25*b* is positioned between a lateral member 23*a*, 23*b*, respectively, and a bar stop member 29 and each lower grille support 25*a*, 25*b* is positioned abutting a lateral member 25*a*, 25*b*, respectively, thereby preventing lateral movement of grille 17 when positioned on supports 23*a*, 23*b* and 27*a*, 27*b***.

Vertical movement of grille 17 is restricted by latch mechanism 31 which is positioned remote from opening 13. By remote, Applicant means that the latch 31 is located at a position far enough from opening 13 that someone outside the building could not reach in the opening 13 and operate latch 31. Thus, latch 31 could be mounted above (FIG. 8), below (FIGS. 1,2,6 and 7) or to the side (not shown) of opening 13. This advantageous arrangement avoids the need for any key-operated locking mechanism which is a necessity for latches which are positioned along the opening 13.

Figure 3:
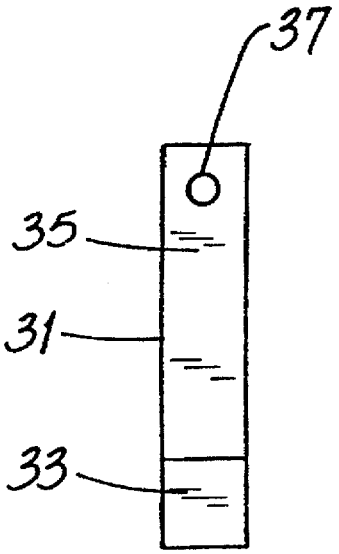
FIG. 3 is a front elevation of one embodiment of the remote latching mechanism.
Figure 4:
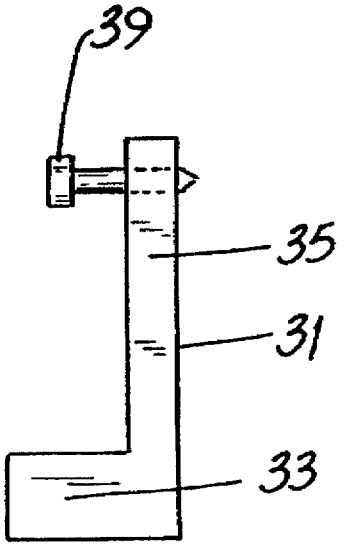
FIG. 4 is a side elevation view of one embodiment of the remote latching mechanism.
Figure 5:
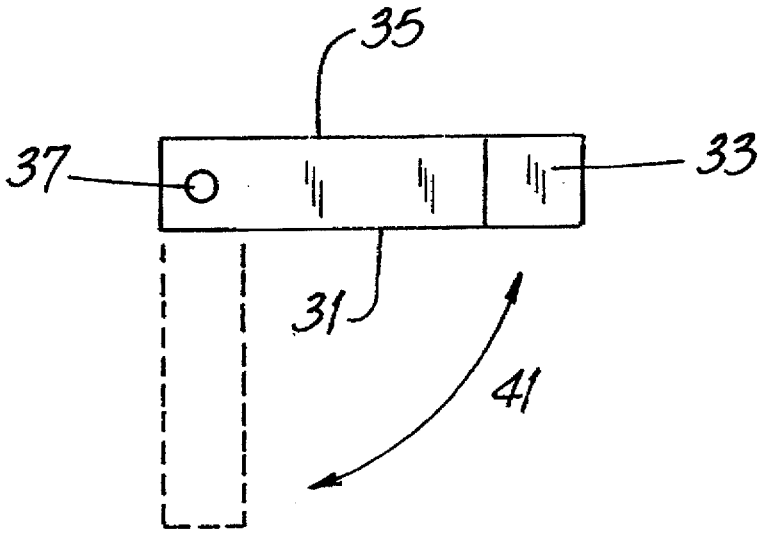
FIG. 5 shows one embodiment of the remote latching mechanism and represents the pivotal movement of such latch.

FIGS. 3–5 show one embodiment of a preferred latch 31. Latch 31 may include a latch stop member 33 and an arm 35. Latch opening 37 is positioned in arm 35 for securing latch 31 to a surface such as wall 15. Any suitable fastener (such as lag screw 39) may be used to secure latch 31 to surface 15. As shown in FIGS. 2 and 5 latch 31 is preferably pivotally mounted to wall surface 15 as represented by number 41.

Figure 6:
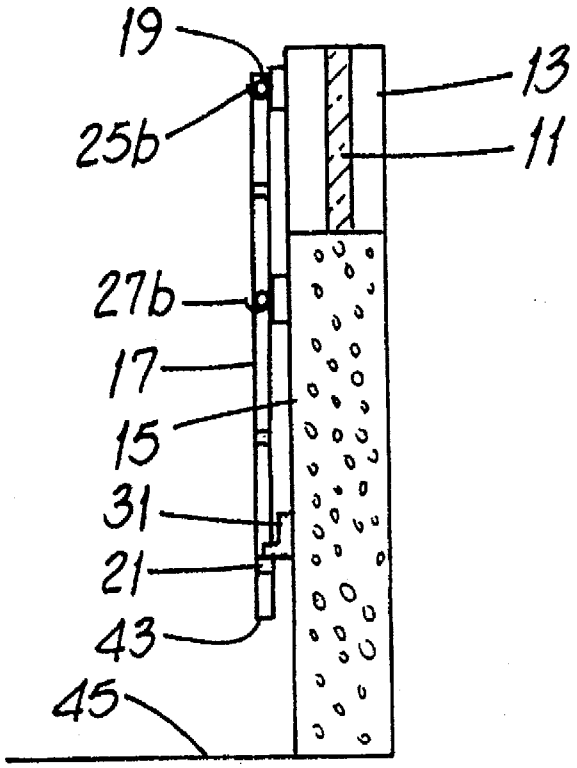
FIG. 6 is a side elevation of the invention showing the grille in a "security position" mounted over a building opening.

As shown in FIGS. 1 and 6, stop member 33 is positioned below latch opening 37 to be in engagement with horizontal member 21. Latch 31 could be in contact with other horizontal members 24 provided such members are remote from the opening 13. As shown in FIG. 8, the latch 31 may also be positioned above grille 17 and in engagement with upper horizontal bar member 19. Preferably, stop member 33 may be weighted such that gravity maintains stop member 33 in engagement with its corresponding horizontal member.

In either arrangement, latch 31 and supports 25*a*, 25*b* and 27*a*, 27*b* prevent grille 17 from being moved upwardly, off supports 25*a*, 25*b* and 27*a*, 27*b* and away from opening 13. However, grille 17 may be easily and rapidly removed from supports 25*a*, 25*b* and 27*a*, 25*b* simply by pivoting latch 31 away from horizontal member 21 and lifting grille 17 off of supports 25*a*, 25*b* and 27*a*, 27*b*.

Figure 7:
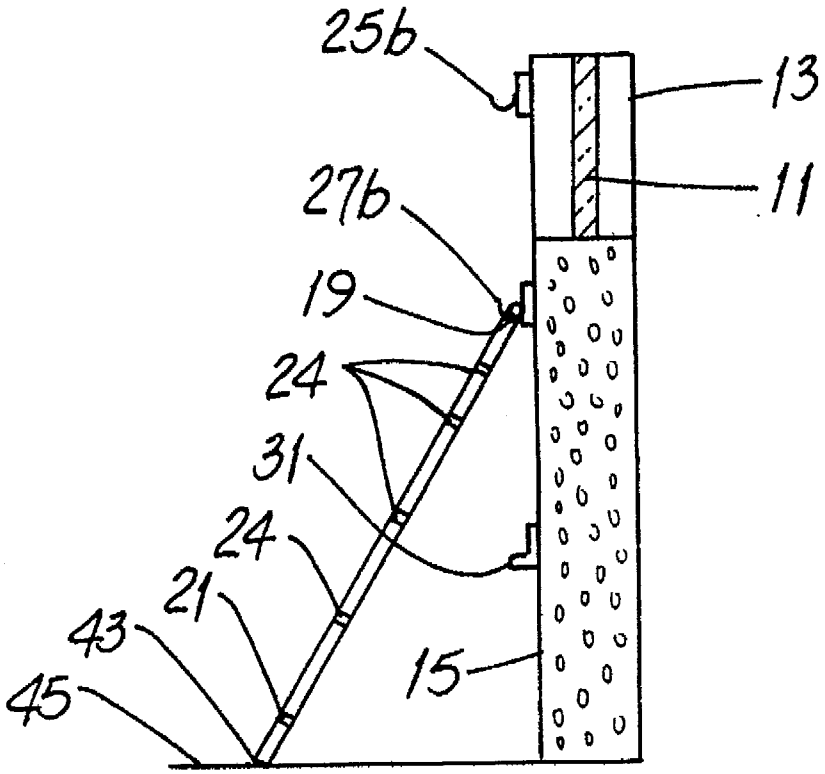
FIG. 7 is a side elevation of the invention showing the grille in a "support position" to facilitate egress through the building opening.

FIGS. 1 and 6 and 7 show the invention in its "support" and "security" positions respectively. In the security position shown in FIGS. 1 and 6, horizontal members 19 and 24 are received in grille upper 25*a*, 25*b* and lower 27*a*, 27*b* supports, respectively. At least one horizontal member such as 19 or 24 is positioned to obstruct opening 13.

In the support position shown in FIG. 7, grille 17 is positioned to act as a ladder-like support to assist a person inside the building in exiting through opening 13. Lower grille supports 27*a*, 27*b* receive upper horizontal bar member 19 and the bearing end 43 of grille 17 is positioned against bearing surface 45. The grille 17 is, therefore, preferably at an angle relative to surface 15 to further facilitate egress through opening 13.

FIG. 8 shows yet another embodiment of Applicant's invention used to assist in exiting from the opening 13 to the ground outside the building. In this embodiment, a pair of grille supports 47*a* (not shown) and 47*b* are positioned on the building exterior surface 49. Paired grille supports 47*a*, 47*b* are positioned to receive upper horizontal bar member 19 of grille 17. Grille 17 may further include a pair of extenders 51*a* (not shown) and 51*b* each pivotally mounted to a lateral member 23*a* or 23*b* and extensible toward the building exterior 49 for supporting grille 17 along the building. Preferably, a stop, such as a chain 53, limits movement of each extender 51*a*, 51*b* so that each extender 51*a* or 51*b* supports grille 17 with respect to exterior surface 49. In this embodiment, grille structure 17 may be removed from opening 13 and positioned outside the building to facilitate egress through opening 13.

According to the method of this invention, grille 17 is positioned in the security position by removably securing grille 17 with respect to opening 13 thereby preventing access through such opening. Grille 17 is secured by latching mechanism 31 which is moved into a position so that stop member 33 abuts horizontal member 21 thereby preventing removal of grille 17 from supports 25*a*, 25*b* and 27*a*, 27*b*.

Grille 17 may be rapidly placed into its support position for use as a ladder-like support for exiting the building by the steps of disengaging latch stop member 33 from horizontal member 21, removing grille 17 from opening 13, and securing grille upper horizontal member 19 to lower supports 27*a*, 27*b*. The grille 17 may then be used as a support to exit through opening 13.

As exemplified by FIG. 8, the invention may also be used as a ladder-like support to exit from the opening 13 to the ground outside the building. This novel method involves the steps of disengaging the latching mechanism 31, removing grille structure 17 from opening 13 and securing grille upper horizontal member 19 to grille supports 47*a*, 47*b* positioned on the building exterior surface 49.

While the principles of this invention have been described in connection with specific embodiments, it should be understood clearly that these descriptions are made only by way of example and are not intended to limit the scope of the invention.

What is claimed:

1. An apparatus preventing ingress through an opening in a building, such apparatus serving as a support to exit the building through the opening, the apparatus including a grille structure removably secured with respect to the opening and having (a) an upper horizontal bar member, (b) at least one lower horizontal bar member, (c) a pair of laterally-disposed vertical members coupled to the horizontal members, and (d) a latch mechanism for limiting movement of the grille structure, the improvement wherein:

the grille structure is secured within the building;

the latch mechanism moves between a first position limiting upward movement of the grille structure with respect to the building and a second position permitting upward removal of the grille structure; and the latch mechanism is remote from the opening and accessible only from inside the building;

whereby the latch mechanism may be manipulated only from the inside the building.

2. The apparatus of claim 1 wherein the latch mechanism is pivotally mounted to an interior wall surface region remote from the opening and the latch mechanism may be quickly moved to a position which does not interfere with removal of the grille structure.

3. The apparatus of claim 2 wherein the latch mechanism includes:

an arm having an opening for attaching the latch to a surface remote from the opening; and a latch stop member attached to the arm for engaging one of the horizontal bar members.

4. The apparatus of claim 1 further including:

a pair of upper grille supports positionable inside the building for receiving one horizontal bar member;

a pair of lower grille supports positionable inside the building for receiving another horizontal bar member; and the grille supports are positionable adjacent to the lateral members to interfere with lateral movement of the grille structure;

whereby the grille structure is removably secured with respect to the opening.

5. The apparatus of claim 4 wherein the supports are upwardly-opening hooks.

6. The apparatus of claim 4 wherein:

the lower grille supports are configured and arranged to receive the upper horizontal bar member;

the upper horizontal bar member is positioned in the lower grille supports;

whereby the opening is unobstructed and the grille structure acts as a ladder-like support for exiting the building through the opening.

7. The apparatus of claim 6 wherein:

the grille structure has a bearing end opposed from the upper horizontal member for supporting the grille structure; and the bearing end is supported on a bearing surface.

8. The apparatus of claim 4 further including:

a pair of exterior grille supports positionable on the building exterior surface configured and arranged to receive the upper horizontal bar member; and the upper horizontal bar member is positionable in the lower grille supports;

whereby the grille structure is placed outside the building on the exterior supports to act as a ladder-like support for exiting the building.

9. The apparatus of claim 8 further including:

a pair of grille extenders each pivotally mounted to a lateral member and extensible toward the building exterior; and stop member on at least one lateral member to position the extenders for supporting the grille structure against the building.

10. A removable security bar apparatus having a security position, barring entry into a building opening and a support position serving as a support to exit the building through the opening comprising:

a grille structure which is removably positioned inside the building over substantially all of the opening, the grille having a top elongate horizontal member, a plurality of spaced-apart lower elongate horizontal members and a pair of elongate vertical members attached to respective ends of the top and lower horizontal members;

a pair of grille upper supports for attachment inside the building and for removably receiving one horizontal member in the security position, each upper support being positionable adjacent to one vertical member to interfere with lateral movement of the grille structure;

a pair of grille lower supports for attachment inside the building for removably receiving one horizontal member in the security position, and the top horizontal member in the support position, each lower support being positionable adjacent to one vertical member to interfere with lateral movement of the grille;

a movable latch for mounting to an interior building surface remote from the opening, the latch mechanism having a first position for limiting upward movement of the grille structure when in the security position and a second position permitting upward removal of the grille structure;

whereby the grille structure may be rapidly positioned in either the security position or support position.

11. The apparatus of claim 10 wherein:

the top elongate horizontal member has first and second ends which project beyond the vertical members;

each end terminates in a stop member;

each upper support is positionable between its respective vertical member and stop member to interfere with lateral movement of the grille structure.

12. The apparatus of claim 10 wherein the supports are upwardly-opening hooks for attachment to the inside of the building and for receiving the respective horizontal members.

13. The apparatus of claim 10 wherein the latch is pivotally mounted to an interior wall surface region remote from the opening and the latch may be moved to a position which does not interfere with removal of the grille structure.

14. The apparatus of claim 10 further including a pair of grille supports positionable on an exterior building surface for receiving the top elongate upper horizontal member;

whereby the grille structure may be removed from the opening and positioned outside the building for exiting through the opening.

15. The apparatus of claim 14 further including a pair of grille extenders each pivotally mounted to a vertical member and extensible toward the building exterior for supporting the grille structure against the building.

16. A method of preventing ingress through a building opening end for exiting the building through the opening, the prevention of ingress comprising the steps of:

providing a grille structure having upper and lower horizontal bar members and a pair of lateral members coupled to the horizontal members;

securing a latching mechanism remote from the window opening;

removably securing the grille structure inside the building with respect to the opening; and engaging the latching mechanism with respect to the grille structure to limit upward movement of the grille structure and removal thereof; and wherein exiting the building comprises the steps of:

disengaging the latching mechanism;

removing the grille structure from the opening; and securing the grille structure inside the building and with respect to the opening such that the qrille structure acts as a support for gaining access to the opening for egress through the opening.

17. A method of preventing ingress through a building opening and for exiting the building through the opening, the prevention of ingress comprising the steps of:

providing grille structure having upper and lower horizontal bar members and a pair of lateral members coupled to the horizontal members;

securing a latching mechanism remote from the window opening;

removably securing the grille structure inside the building with respect to the opening; and engaging the latching mechanism with respect to the grille structure to limit upward movement of the grille structure and removal thereof; and wherein exiting the building comprises the steps of:

disengaging the latching mechanism;

removing the grille structure from the opening; and securing the grille structure outside the building and with respect to the opening such that the grille structure acts as a support for egress through the opening.

* * * * *